US006986436B2

(12) United States Patent
Smith

(10) Patent No.: US 6,986,436 B2
(45) Date of Patent: Jan. 17, 2006

(54) STORAGE CONTAINER WITH REMOVABLE SLEEVE

(75) Inventor: Ernest L. Smith, Kansas City, MO (US)

(73) Assignee: Huhtamaki Consumer Packaging, Inc., DeSoto, KS (US)

( * ) Notice: Subject to any disclaimer, the term of this patent is extended or adjusted under 35 U.S.C. 154(b) by 0 days.

(21) Appl. No.: 10/441,720

(22) Filed: May 20, 2003

(65) Prior Publication Data

US 2004/0232157 A1 Nov. 25, 2004

(51) Int. Cl.
*B65D 90/06* (2006.01)

(52) U.S. Cl. ..... 220/660; 40/306; 229/87.05

(58) Field of Classification Search ..... 220/62.2, 220/660, 319, 266, 270; 40/306, 310; 215/253, 215/274; 229/87.05; 283/103–105, 81
See application file for complete search history.

(56) References Cited

U.S. PATENT DOCUMENTS 1,756,944 A * 5/1930 Gorton, Jr. ..... 40/306
1,974,401 A * 9/1934 Miller ..... 40/306
3,396,899 A * 8/1968 Vincent et al. ..... 229/125.05
3,737,093 A * 6/1973 Amberg et al. ..... 206/447
4,550,854 A * 11/1985 Schellenberg ..... 220/62.2
5,025,981 A 6/1991 Schellenberg
5,366,087 A * 11/1994 Bane ..... 206/459.5
5,568,695 A * 10/1996 Kough ..... 40/124.09
5,639,529 A * 6/1997 Gozdecki et al. ..... 428/40.1
5,911,360 A 6/1999 Schellenberg
6,371,335 B1 4/2002 MacEwen
6,770,345 B2 * 8/2004 Sellars ..... 428/40.1

* cited by examiner

*Primary Examiner*—Joseph C. Merek
(74) *Attorney, Agent, or Firm*—Blackwell Sanders Peper Martin LLP

(57) ABSTRACT

Generally described, a storage container comprising a removable sleeve positively closely positioned around a receptacle is provided. When positioned on the receptacle, the ends of the sleeve overlap, and the outer overlapping portion is bonded or secured to at least one separation section within an inner overlapped portion. The separation section is defined at least partially by a scored line, with the scored line being a cut that penetrates a top portion of the sleeve. The sleeve is removed by pulling the outer edge of the sleeve radially outward thereby separating the top portion of the sleeve at the separation section from the remaining portion of the sleeve.

3 Claims, 2 Drawing Sheets

STORAGE CONTAINER WITH REMOVABLE SLEEVE

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

This invention relates generally to a storage container having a removable sleeve, and, more specifically, to a storage container having a removable sleeve that includes an outer overlapping portion which is secured to at least one separation section within an inner overlapped portion, the separation section being defined at least partially by a scored line.

The storage container of the present invention is suitable to store a variety of items from dry goods to dairy products. Generally, a storage container must be capable of withstanding the stress of loading, transportation, and use while being simple and inexpensive to manufacture and assemble. One manner of accomplishing these goals is to provide a receptacle surrounded by a positively closely positioned sleeve. There are several advantages to this type of storage container. First, the sleeve provides reinforcement to the receptacle so that the receptacle requires less material. Second the sleeve provides an area for a label or an advertisement that may be applied to the sleeve before it is positioned on the receptacle. Printing in this manner is often less complicated than printing on the receptacle itself.

Besides being sturdy and inexpensive, a storage container also should be capable of being disposed of after use in an efficient manner. Often, the most efficient way to dispose of a used storage container is to recycle the container. However, if the storage container has several components, then a user must separate those components before they can be recycled. Unfortunately, a user may forego the option to recycle if it is too difficult or time-consuming to separate a storage container into its component parts. Therefore, it is advantageous to provide a storage container that a person may quickly and easily break down into its component parts. Thus, for a storage container comprised of a receptacle surrounded by a sleeve, the sleeve must be quickly and easily removable.

One example of a packing container having a circumferential reinforcing sleeve is found in U.S. Pat. No. 5,025,981, which discloses a plastic packing container with a positively closely held cardboard sleeve. The cardboard sleeve includes a predetermined separation strip, which is a portion of the sleeve that tears or is torn away from the sleeve to permit a complete severing of the sleeve, a gripping tab, and a weakening line. For separating the cardboard sleeve from the otherwise plastic packing container, the gripping tab is drawn radially outwards, so that the predetermined separation strip is separated from the cardboard sleeve along the weakening line, which is comprised of angular incisions, arranged in rows, that extend for substantially the from the upper edge to the lower edge of the cardboard sleeve, with the incisions penetrating the cardboard sleeve. Thus, to produce the sleeve disclosed in this invention, a manufacturer must make a relatively complicated cardboard sleeve part having a perforation line, two incisions and a top edge that is shaped at one end to form a gripping tab. A simpler sleeve would be easier to use and produce. Although sufficient, the packing container of this patent may be improved, particularly with respect to the complicated design and construction of the sleeve.

Accordingly, the purpose of this invention is to provide a storage container having a removable sleeve that is simple to manufacture, assemble and use.

SUMMARY OF THE INVENTION

The present invention is generally directed to a storage container comprising a removable sleeve positively closely positioned around a receptacle. When positioned on the receptacle, the ends of the sleeve overlap, and the outer overlapping portion is bonded or secured to at least one separation section within an inner overlapped portion. The separation section is defined at least partially by a scored line, with the scored line being a cut that penetrates a top portion of the sleeve. The sleeve is removed by pulling the outer edge of the sleeve radially outward thereby separating the top portion of the sleeve at the separation section from the remaining portion of the sleeve.

BRIEF DESCRIPTION OF THE DRAWING

In the accompanying drawings which form a part of the specification and are to be read in conjunction therewith and in which like reference numerals are used to indicate like parts in the various views.

DETAILED DESCRIPTION OF THE INVENTION

Figure 1:
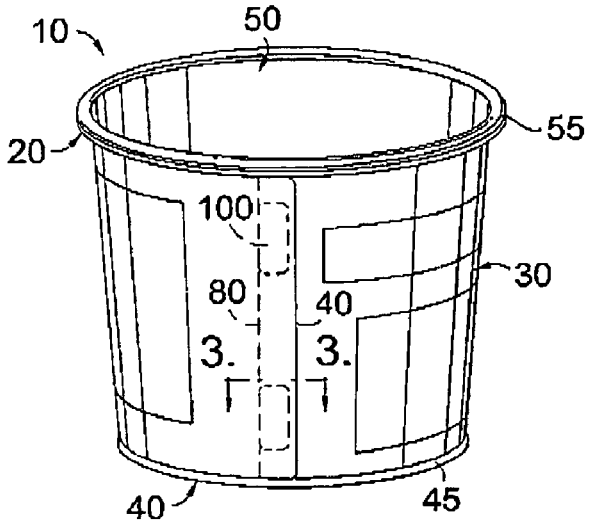
FIG. 1 is a perspective view of a storage container with a removable sleeve according to a preferred embodiment of the present invention with the overlapped edge shown in dotted lines.

Referring now to the drawings in more detail and initially to FIG. 1 in particular, the numeral 10 generally designates a storage container that includes a receptacle 20 and an easily removable sleeve 30 according to one embodiment of the present invention.

Receptacle 20 has a circular bottom segment 40 and a circumferential wall segment 50. At the top of wall segment 50 is an outwardly projecting marginal flange 55. At the bottom of wall segment 50 is an outwardly projecting rounded step 45. Receptacle 20 preferably has a frusto-conical shape; that is, receptacle 20 has a circular cross-section, and the diameter of bottom segment 40 is less then the diameter of the top of wall segment 50. It should be understood that different shapes may serve equally as well and may actually be required by a given application. For example, a receptacle in the shape of a cube may provide better stacking or space utilization characteristics. Receptacle 20 is preferably constructed of a thermoplastic material.

Figure 2:
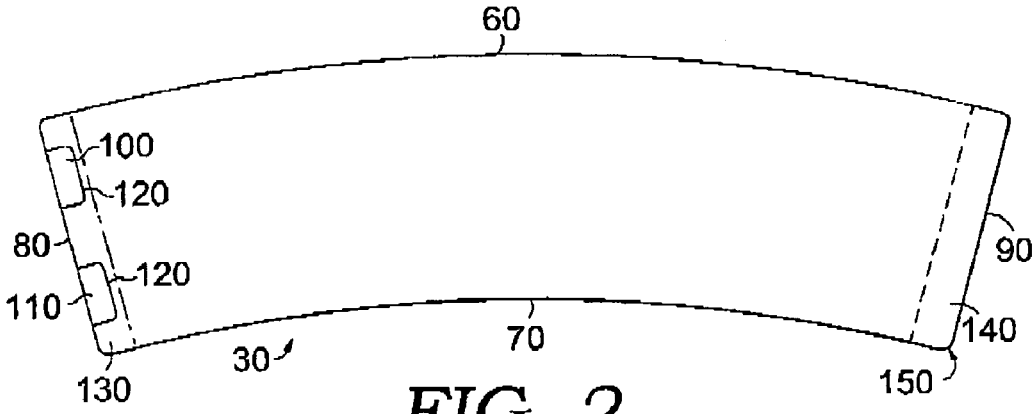
FIG. 2 is a side elevational view of a removable sleeve according to a preferred embodiment of the present invention.

Sleeve 30, which is positively closely positioned around wall segment 50 of receptacle 20 between flange 55 and step 45, provides structural support to receptacle 20 and also provides an area for printing or advertising. Sleeve 30 is preferably constructed of paperboard or cardboard. As shown in FIG. 2, sleeve 30 is defined by a curved top edge 60, a curved bottom edge 70, an inner side edge 80, and an outer side edge 90. A generally rectangular overlapped portion 130 is located lateral to inner side edge 80. A similarly generally rectangular overlapping portion 140 is located lateral to outer side edge 90.

Continuing with FIG. 2, two separation sections 100, 110 are positioned within overlapped portion 130. Each of separation sections 100,110 is defined by inner side edge 80 and a scored line 120, which is roughly in the shape of a reverse "C" in this Figure. It should be understood that the scored line might be a number of different shapes. For example, the separation section may take the shape of a triangle so that the scored line is two straight lines forming an acute angle. It also should be noted that it is not necessary for inner side edge 80 to define a portion of separation sections 100, 110; that is, the sections may be completely defined by a scored line. Using inner side edge 80 in this manner, however, decreases the length of scored line 120 necessary to fully define separation sections 100,110.

Figure 3:
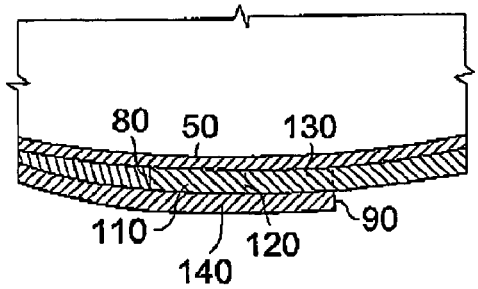
FIG. 3 is a top view taken along line 3—3 in FIG. 1 before the separation of the removable sleeve.

It is known that scored line 120 may be produced by cutting or slicing through a fractional part of sleeve 30 with a sharp, thin instrument or blade. The effect of producing a scoring line is best seen in FIG. 3. Specifically, in FIG. 3, it may be discerned that scored line 120 extends only partway through portion 130. It should be understood that the score line is not limited by depth or length except that it cannot totally penetrate portion 130.

FIG. 3 shows sleeve 30 closely positioned around wall segment 50 of receptacle 20 with portion 140 overlapping and coupled to portion 130. Importantly, portion 140 is joined or connected to portion 130 only at separation areas 100 (which is not shown in this figure) and 110. One method of joining or connecting portion 140 to separation section 110 is to bond portion 140 to section 110. First, a varnish is applied to the outer surface of portion 130, i.e. the surface that faces portion 140, except no varnish is applied to the outer surface of separation section 110. Next, the inner surface of portion 140 is placed on top of and in contact with the outer surface of portion 130, including the outer surface of separation section 110, and then heat is applied. The heat causes the inner surface of portion 140 to adhere to the outer surface of separation section 110 while the varnish prevents the inner surface of portion 140 from adhering to the remaining outer surface of portion 130. Another method for joining or connecting portion 140 to separation section 110 is to apply an adhesive to the outer surface of separation section 110, and then place the inner surface of portion 140 on top of and in contact with the outer surface of portion 130 including separation sections 100, 110.

Figure 4:
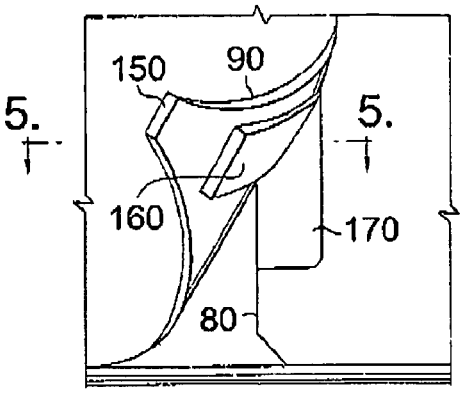
FIG. 4 is a side elevation view of a storage container according to one preferred embodiment of the present invention following the partial separation of the removable sleeve.

Sleeve 30 is removed from receptacle 20 by pulling radially outward on outer side edge 90 of sleeve 30. FIG. 4 depicts lower corner 150 of sleeve 30 being pulled radially outward with top portion 160 of separation section 110 partially separated from remaining portion 170 of separation section 110. As explained above, the inner surface of overlapping portion 140 is bonded or glued to overlapped portion 130 only at the outer surface of separation sections 100, 110. The force required to break this bond is greater than the force required to separate the top portion of the sleeve from the remaining portion of the sleeve. Therefore, as outer side edge 90 is pulled away, top portion 160 of the separation section remains bonded or glued to the inner surface of portion 140 while tearing away or separating from remaining portion 170 of separation section 110. Once the top portions of both separation sections 100, 110 are completely separated from the remaining portions of separation sections 100, 110, sleeve 30 is no longer closely held to wall segment 50 of receptacle 20.

Figure 5:
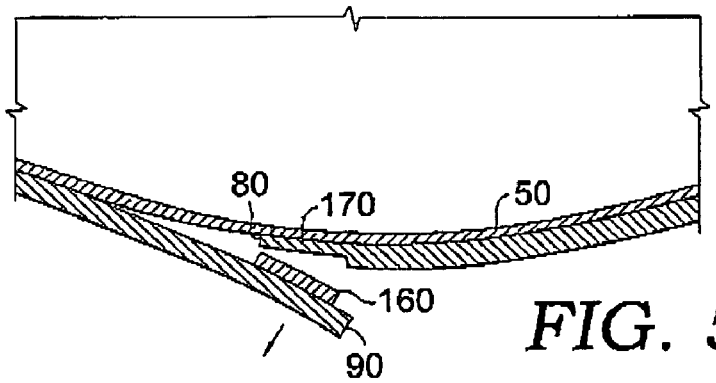
FIG. 5 is top view taken along line 5—5 in FIG. 4 following the partial separation of the removable sleeve.

FIG. 5 also shows outer side edge 90 being pulled radially outward as indicated by the arrow. As stated above, when outer side edge 90 is pulled radially outward, top portion 160 of separation section 110 remains bonded to the inner surface of portion 140 and separates from remaining portion 170. It should be noted that the depth of top portion 160 is equal to the depth of scored line 120.

Figure 6:
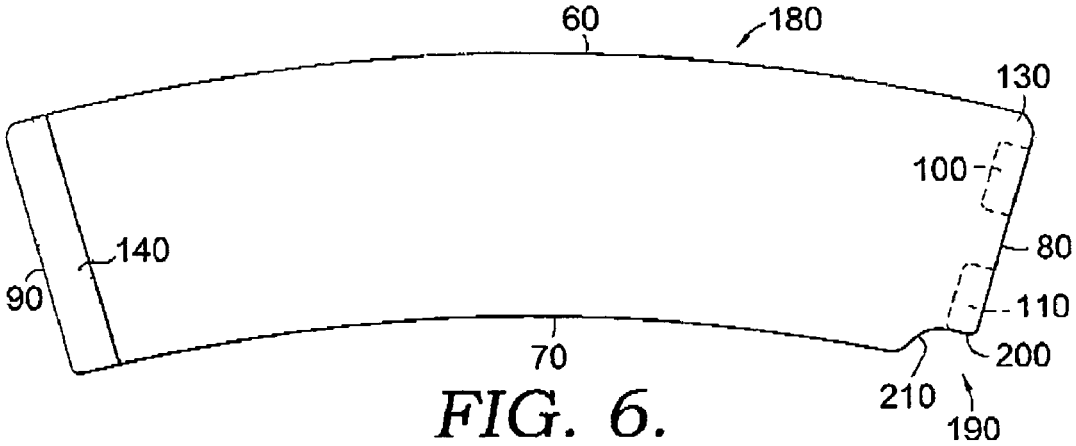
FIG. 6 is a side elevational view of a removable sleeve containing a finger notch according to a preferred embodiment of the present invention.
Figure 7:
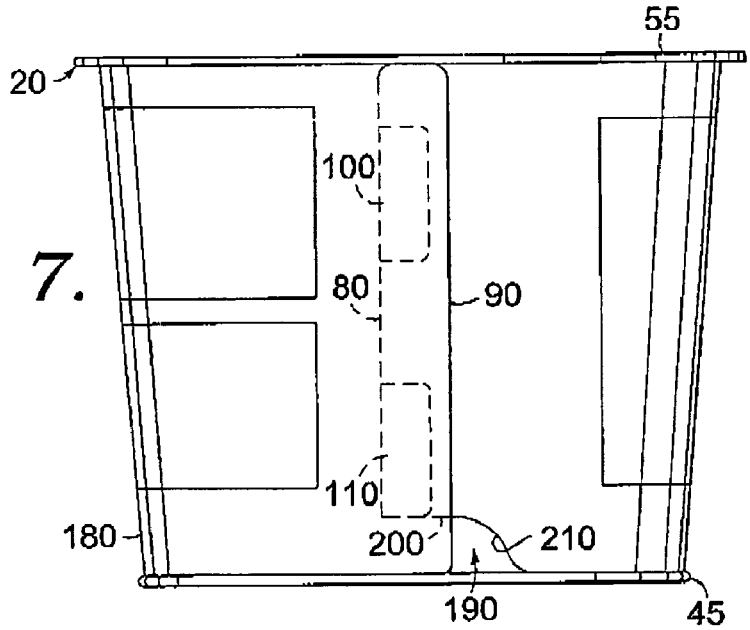
FIG. 7 is a side elevation view of a storage container with removable sleeve containing a finger notch according to a preferred embodiment of the present invention.

As shown in FIGS. 6 and 7, sleeve 180 includes an additional feature. Specifically, sleeve 180 contains a finger notch 190. As seen in FIG. 2, for sleeve 30, inner side edge 80 extends the full length of sleeve 30 before it meets bottom edge 70, and the intersection of inner side edge 80 and lower edge 70 forms a right angle corner. For sleeve 180, however, inner side edge 80 does not extend the full length of sleeve 180. Instead, inner side edge 80 ends at the bottom of separation area 110 or at a height equal to the length of first area 130. Finger notch 190, which begins where inner side edge 80 ends, is defined by a straight portion 200 and a curved portion 210. Straight portion 200 extends in a generally parallel manner to top side edge 60 and bottom side edge 70 for a length equal to the length of portion 130. Thereafter, curved portion 210 curves down to meet lower side edge 70. The radius of curved portion 210 is at least the length of portion 130.

It will be appreciated by persons skilled in the art that the present invention is not limited to what has been particularly shown and described hereinabove. Rather, all matter shown in the accompanying drawings or described hereinabove is to be interpreted as illustrative and not limiting. Accordingly, the scope of the present invention is defined by the appended claims rather than the foregoing description.

What the invention claimed is:

1. A storage container comprising:

a receptacle having a circumferential wall segment;

a sleeve having an inner side edge, and an outer side edge, said sleeve further comprising a first portion extending laterally from said inner side edge, said first portion containing at least one separation section defined at least partially by a scored line, said sleeve further comprising a second portion extending laterally from said outer side edge, wherein said sleeve is closely positioned around said wall section of said receptacle with said second portion overlapping said first portion and connected to said separation section, and wherein said sleeve is removable from said receptacle by pulling said outer side edge generally radially outward causing said separation section to separate from said first portion and remaining attached to the second portion with said sleeve being one piece when removed; and wherein said separation section comprises two spaced apart separation sections.

2. A storage container comprising:

a receptacle having a circumferential wall segment;

a sleeve having an inner side edge, and an outer side edge, said sleeve further comprising a first portion extending laterally from said inner side edge, said first portion containing at least one separation section defined at least partially by a scored line, said sleeve further comprising a second portion extending laterally from said outer side edge, wherein said sleeve is closely positioned around said wall section of said receptacle with said second portion overlapping said first portion and connected to said separation section, and wherein said sleeve is removable from said receptacle by pulling said outer side edge generally radially outward causing said separation section to separate from said first portion and remaining attached to the second portion with said sleeve being one piece when removed; and wherein said separation section has a perimeter defined completely by a scored line.

3. A storage container comprising:

a receptacle having a circumferential wall segment;

a sleeve having an inner side edge, and an outer side edge, said sleeve further comprising a first portion extending laterally from said inner side edge, said first portion containing at least one separation section defined at least partially by a scored line, said sleeve further comprising a second portion extending laterally from said outer side edge, wherein said sleeve is closely positioned around said wall section of said receptacle with said second portion overlapping said first portion and connected to said separation section, and wherein said sleeve is removable from said receptacle by pulling said outer side edge generally radially outward causing said separation section to separate from said first portion and remaining attached to the second portion with said sleeve being one piece when removed; and wherein when said separation section is separated from the first portion, a portion of the first portion integral with and defined by a projection of the scored line separates from the separation portion and remains integral with the first portion.

* * * * *